United States Patent [19]

Bernard et al.

[11] Patent Number: 4,900,882

[45] Date of Patent: Feb. 13, 1990

[54] ROTATING ARC AND EXPANSION CIRCUIT BREAKER

[75] Inventors: Georges Bernard, St. Egreve; Raymond Bresson, Grenoble; Pierre LeClercq, Moirans; Odile Filleau, St. Nazaire-les-Eymes; Francois Scarponi, Brignoud, all of France

[73] Assignee: Merlin Gerin, France

[21] Appl. No.: 209,927

[22] Filed: Jun. 22, 1988

[30] Foreign Application Priority Data

Jul. 2, 1987 [FR] France ..... 87 09524

[51] Int. Cl.[4] ..... H01H 33/18; H01H 9/44

[52] U.S. Cl. ..... 200/147 R; 200/148 B

[58] Field of Search ..... 200/147 R, 148 B

[56] References Cited

U.S. PATENT DOCUMENTS

| | | | |
|---|---|---|---|
| 4,463,230 | 7/1984 | Perrenoud | 200/147 R |
| 4,511,775 | 4/1985 | Korner et al. | 200/147 R |
| 4,596,910 | 6/1986 | Berta et al. | 200/147 R |
| 4,665,288 | 5/1987 | Ischi | 200/147 R |
| 4,737,607 | 4/1988 | Bernard et al. | 200/147 R |
| 4,786,770 | 11/1988 | Hamano et al. | 200/147 R |

FOREIGN PATENT DOCUMENTS

| | | |
|---|---|---|
| 0078719 | 5/1983 | European Pat. Off. . |
| 0150079 | 7/1985 | European Pat. Off. . |
| 0240397 | 10/1987 | European Pat. Off. . |
| 2422246 | 11/1979 | France . |
| 2459543 | 1/1981 | France . |

*Primary Examiner*—Robert S. Macon

*Attorney, Agent, or Firm*—Arnold, White & Durkee

[57] ABSTRACT

A circuit breaker with expansion and rotating arc in sulphur hexafluoride comprising a metal breaking chamber supporting a stationary main contact capable of cooperating with a movable main contact. The breaking chamber comprises an insulating end plate away from the breaking area and an opposite metal end plate close to the breaking area and supporting a coil or a permanent blowout magnet by rotation of the arc drawn between the arcing contacts housed inside the breaking chamber.

7 Claims, 5 Drawing Sheets

ROTATING ARC AND EXPANSION CIRCUIT BREAKER

BACKGROUND OF THE INVENTION

The invention relates to a circuit breaker with a sealed enclosure filled with a high dielectric strength gas and containing one or more poles of the circuit breaker, each pole comprising:

a breaking chamber having a revolution surface tightly sealed at both its ends by end plates a pair of tubular arcing contacts, coaxially arranged in said breaking chamber and each passing through one of said end plates to make the breaking chamber communicate, in the separated position of the arcing contacts, with said enclosure forming an expansion chamber via the gas outflow channels constituted by the tubular arcing contacts a coil or a permanent magnet supported by one of said end plates inside the breaking chamber so as to create in the arcing contact separation area a magnetic blowout field by rotation of an arc drawn between the separated arcing contacts a pair of main contacts disposed outside the breaking chamber and arranged to open before the arcing contacts separate when a circuit breaker opening operation takes place.

A state-of-the-art circuit breaker combines pneumatic arc blowout by expansion gases with magnetic arc blowout by rotation on annular electrodes. This breaking method can be used in medium or high voltage circuit breakers and has the advantage of requiring low operating forces. It has already been proposed to fit, in addition to the arcing contact ensuring breaking of the current, main contacts conducting the rated current and opening before separation of the arcing contacts takes place. These state-of-the-art devices are complicated and require elaborate electrical connections.

The object of the invention is to achieve a circuit breaker of particularly simple structure and architecture enabling the current conducting and breaking functions to be separated.

SUMMARY OF THE INVENTION

The circuit breaker according to the invention is characterized in that said revolution surface and the end plate supporting the coil or permanent magnet are made of metal and electrically connected to the arcing contact passing through this end plate, the other end plate being made of insulating material to provide electrical insulation in the open position of the contacts and that the annular edge of said revolution surface, adjacent to the insulating end plate is arranged as or supports the stationary main contact.

The revolution surface, in this instance the cylindrical surface of the breaking chamber and the end plate adjacent to the breaking area are made of metal and are used to support or constitute the stationary main contact and its connection to the stationary arcing contact arranged as the current input conductor. The opposite end plate of the breaking chamber is away from the breaking area and being less subjected to thermal and mechanical stresses, it can be made of insulating material providing the electrical insulation in the open position of the circuit breaker. This insulating end plate is advantageously cone-shaped and comprises a cylindrical metal insert surrounding the movable contact with small clearance and electrically connected to the latter, for example by a friction contact formed by an elastic ring. The movable main contact is supported and electrically connected to the movable arcing contact, which simplifies manufacture and assembly of the switchgear device. The stationary main contact and movable main contact assembly is arranged in the extension of the breaking chamber respecting the dimensions of the latter. The main contacts advantageously comprise a tulip-finger contact which may be either securedly fixed to the movable part or securedly fixed to the stationary part of these contacts. According to an alternative embodiment, the tulip-finger contact can be arranged as a contact bridge cooperating with two stationary main contacts disposed facing one another. Each pole can be housed in an individual enclosure in the shape of a coaxial cylinder and external to the breaking chamber or all the circuit breaker poles can be disposed inside a common enclosure of suitable shape. The invention is applicable to a circuit breaker with magnetic arc blowout by a coil, switched into the circuit when the main contacts open or when the arc switches onto an electrode or with magnetic arc blowout by a permanent magnet. The invention is described hereinafter as being applied to a circuit breaker with double pneumatic blowout via the two tubular-shaped arcing contacts but it is applicable to a circuit breaker with single blowout, notably by the gases escaping via the movable contact.

BRIEF DESCRIPTION OF THE DRAWINGS

Other advantages and features will become more clearly apparent from the following description of various illustrative embodiments of the invention, given as non-restrictive examples only and represented in the accompanying drawings, in which.

DESCRIPTION OF THE PREFERRED EMBODIMENT

Figure 1:
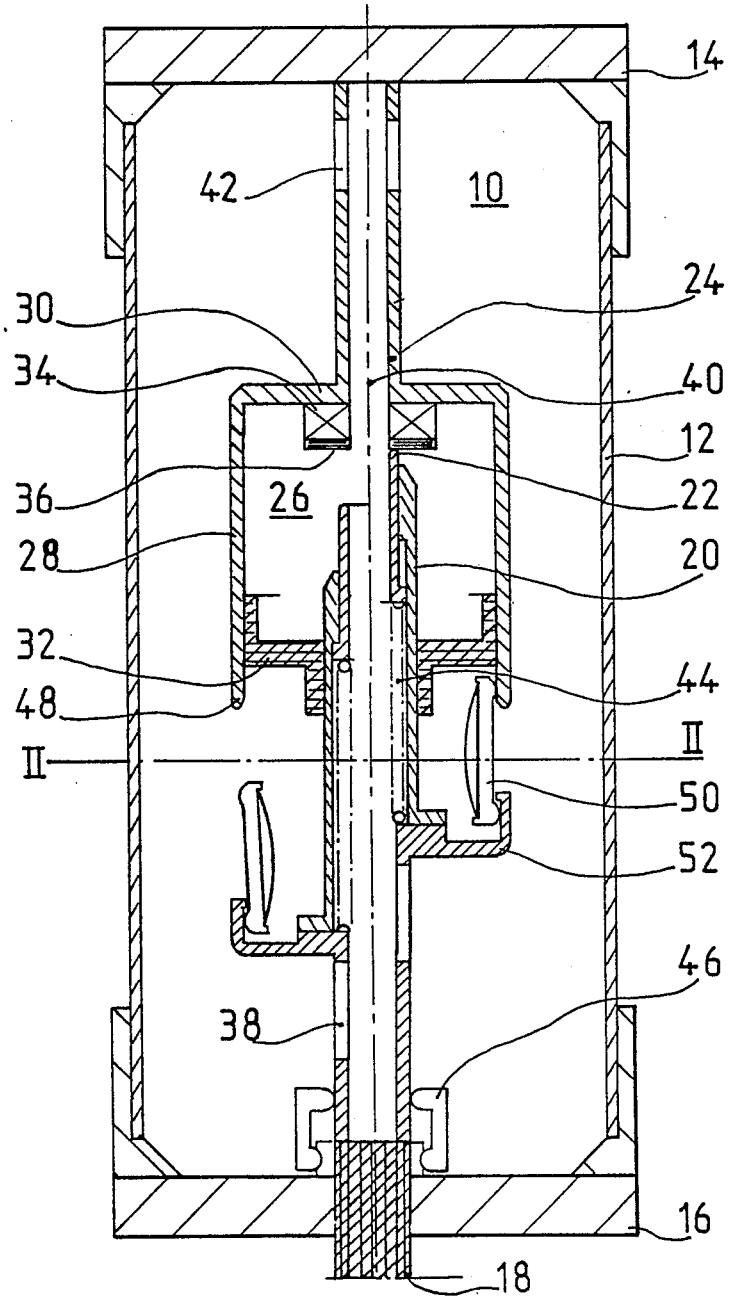
FIG. 1 is a schematic axial sectional view of a circuit breaker according to the invention, the right-hand half-section representing this circuit breaker in the closed position and the left-hand half-section in the open position.
Figure 2:
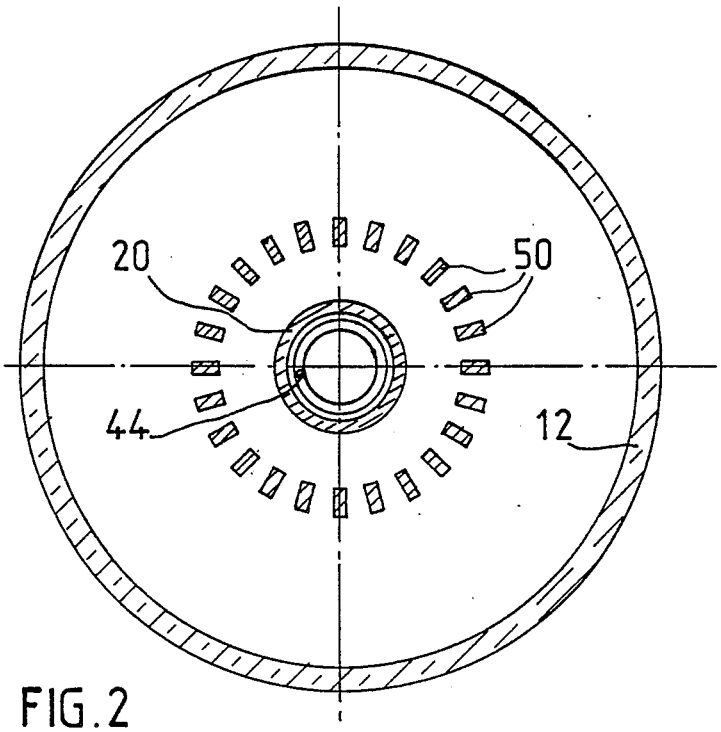
FIG. 2 is a cross-section according to the line II—II of FIG. 1.

In the figures, a pole of a medium voltage or high voltage switch comprises an enclosure 10 confined by a cylindrical casing 12, sealed at its ends by two end plates 14, 16. The enclosure 10 is filled with a high dielectric strength gas, notably sulphur hexafluoride at atmospheric pressure or at overpressure. The cylindrical casing 12 may be of insulating material and the end plates 14, 16 of conducting material constitute current input terminal pads. An operating rod 18, disposed in the axis of the enclosure 10, passes tightly through the end plate 16 and is extended inside the enclosure 10 by a tubular movable contact 20. The tubular movable contact 20 supports at its end a movable arcing contact 22, cooperating with a stationary arcing contact 24 supported by the opposite end plate 14. A breaking chamber 26, formed by a cylindrical surface 28 and two end plates 30, 32, coaxially surrounds the arcing contacts 22, 24. The cylindrical surface 28 and the end plate 30 adjacent to the stationary contact 24 are made of metal and electrically connected to the stationary contact 24. The opposite end plate 32, through which the movable contact 20 passes, is made of insulating material ensuring electrical insulation between the movable contact 20 and the cylindrical surface 28. Inside the breaking chamber 26 there is disposed a coil 34 adjoined to the metal end plate 30. The coil 34 of a well-known type is capped by an electrode 36 forming an arc migration track disposed facing the movable arcing contact 22. The coil 34 is electrically connected on the one hand to the electrode 36 and on the other hand to the end plate 30 so as to be inserted in series between the movable arcing contact 22 and the stationary contact 24 in the closed position of the circuit breaker. In the open position of the circuit breaker represented in the left-hand part of FIG. 1, the breaking chamber 26 communicates with the enclosure 10, which constitutes an expansion chamber, on the one hand via the tubular movable contact 20 whose base has communication orifices 38 between the tubular inside of the contact and the enclosure 10 and on the other hand via the tubular-shaped stationary contact 24, which is extended through the coil 34 by a central channel 40 and which communicates with the enclosure 10 at its base by orifices 42. In the closed position of the circuit breaker represented in the right-hand half-view of FIG. 1, the movable arcing contact 22 is in abutment with the electrode 36 blocking off the two exhaust channels constituted by the contacts 20, 24. The movable arcing contact 22 is a semi-fixed telescopic contact biased by a spring 44 to an extension position. A sliding contact 46, supported by the end plate 16 of the enclosure 10, cooperates with the movable contact 20 to provide the electrical connection of this movable contact 20 and of the current input terminal pad pad constituted by this end plate 16.

The cylindrical surface 28 of the breaking chamber 26 is extended beyond the insulating end plate 32 by a flange 48 arranged as the stationary main contact. The stationary main contact 48 cooperates with a movable main contact 50 constituted by a tulip-finger contact borne by a support 52 securedly fixed to the movable contact 20. The fingers of the tulip contact 50 cooperate with the internal surface of the flange 48 so as to respect the dimensions of the breaking chamber 26, but it is clear that a reverse arrangement so as to grip the flange 48 externally can be used when the dimension of the main contacts is secondary.

Operation of the switch according to the invention is evident from the foregoing description:

In the closed position of the circuit breaker represented in the right-hand half-view of FIG. 1, the current input at a given moment via the terminal pad 16 flows through the sliding contact 46, the movable contact 20, the support 52, the tulip-finger contact 50, the main contact 48, the cylindrical surface 28, the conducting end plate 30, the stationary contact 24 and the output terminal pad 14. A small fraction of the current flows through a parallel circuit formed by the movable arcing contact 22, the electrode 36, the coil 34 and the conducting end plate 30. Opening of the circuit breaker is controled by downwards sliding in FIG. 1 of the operating rod 18 which moves the tulip-finger main contact 50 downwards to a separation position of the stationary main contact 48. During a first phase of the circuit breaker opening movement, the telescopically mounted movable arcing contact 22 remains in abutment with the electrode 36 due to the action of the spring 44. As soon as the main contacts 48, 50 separate, the current is switched to the parallel circuit formed by the movable arcing contact 22 and the coil 34. Opening of the main contacts 48, 50 takes place without an arc forming and as soon as the current is switched to the parallel circuit, the coil 34 generates a magnetic field which blows out the arc forming when the arcing contacts 22, 36 separate in the course of the continued opening movement of the circuit breaker. The arc drawn into the breaking chamber 26 causes a temperature rise and a pressure increase of the gas contained in this chamber, which gas escapes via the tubular contacts 20, 24 to the expansion chamber formed by the enclosure 10, pneumatically blowing out the arc extending between the movable arcing contact 22 and the electrode 36. The combined action of rotational blowing of the arc and pneumatic blowing by expansion ensures high-speed arc extinction. The breaking area is disposed in the vicinity of the metal end plate 30 of the breaking chamber 26 whereas the opposite end plate made of insulating material 32 is located away from and protected from the action of the arc. By disposing the insulating end plate 32 away from the breaking area, the risks of pollution and breakdown are limited while at the same time arranging a breaking chamber 26 with a cylindrical metal enclosure 28 ensuring electrical connection of the stationary main contact 48 and the stationary contact 24. The overall assembly is particularly simple and compact.

In the example described above, the coil 34 is switched into the circuit as soon as the main contacts 48, 50 open but it is clear that this switching into circuit can be achieved in a manner known in itself by switching of the arc onto the electrode 36. The coil 34 can also be replaced by a permanent magnet and the pneumatic blowout can be performed via one of the contacts, notably the movable contact 20. A multipole circuit breaker is constituted by an association of several poles but an enclosure 10 common to all the circuit breaker poles can be used, the shape of the enclosure naturally being suited to the disposition of the poles inside this enclosure.

The structure of the main contacts 48, 50 may be different and two alternative embodiments are described hereinafter as examples with reference to FIGS. 3 and 4. In these figures, the same reference numbers are used to designate identical or similar parts to those in FIG. 1.

Figure 3:
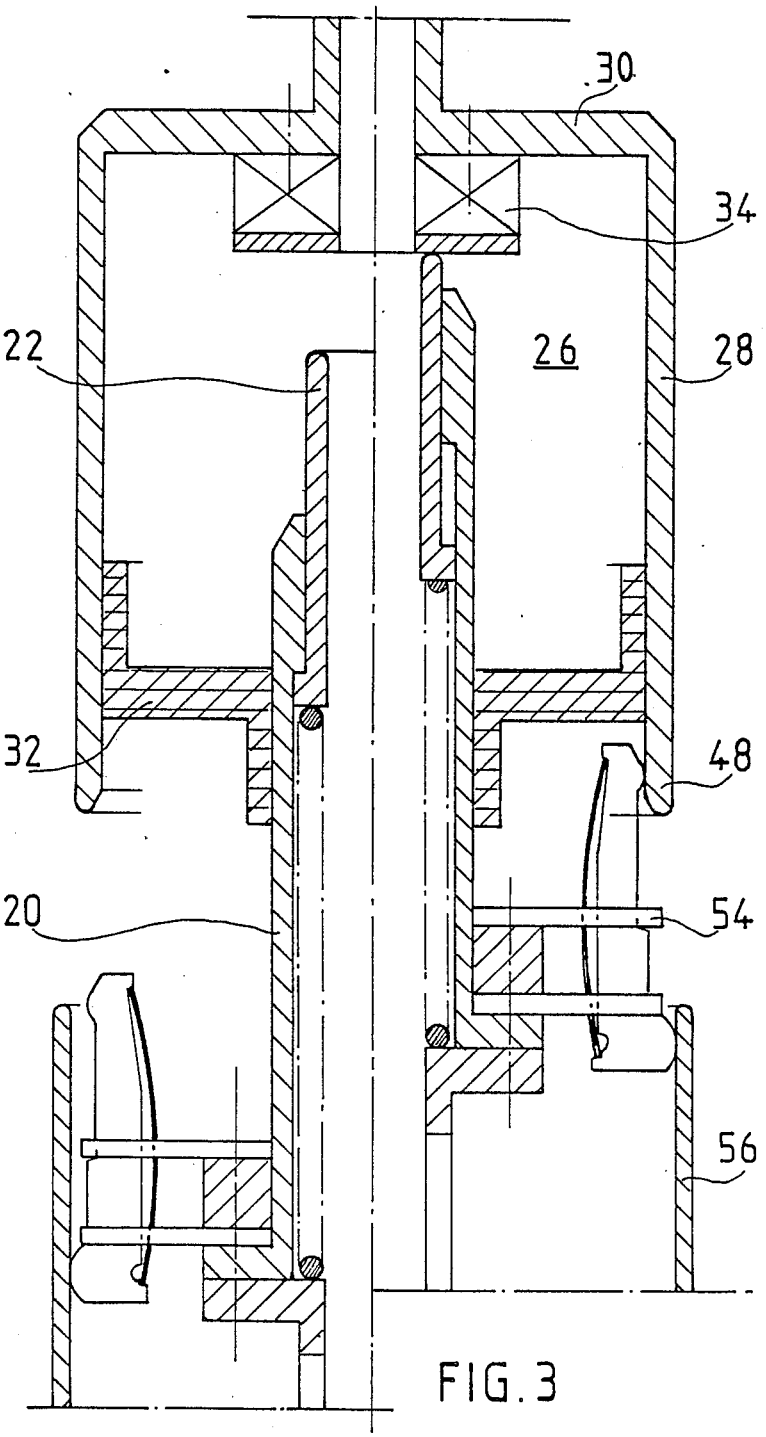
FIG. 3 is a partial view on an enlarged scale of an alternative embodiment of the breaking chamber according to FIG. 1.

In FIG. 3, the movable contact 20 supports a movable main contact 54 in the form of a tulip-finger contact bridge. In the closed position of the circuit breaker represented in the right-hand half-view, the tulip-finger contact bridge 54 cooperates on the one hand with the stationary main contact 48 supported by the breaking chamber 26 and on the other hand with a cylindrical stationary contact 56 electrically connected to the current input terminal pad 16. When breaking of the circuit breaker occurs, the bridge contact 54 is retracted inside the cylindrical stationary contact 56 separating from the stationary main contact 48 in the manner described above. This arrangement of the main contacts in a contact bridge enables a better separation of the main current circuit and of the shunt circuit but the operation is not modified.

Figure 4:
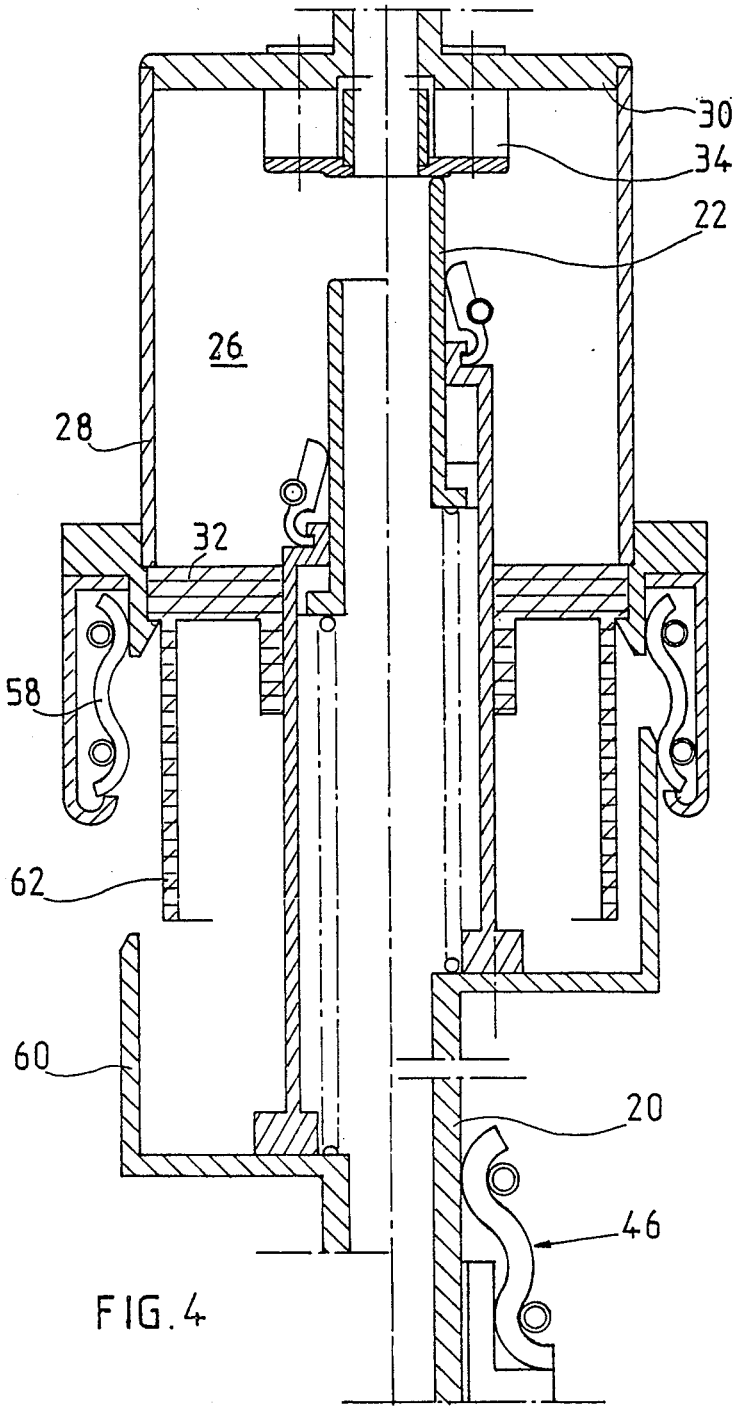
FIGS. 4 and 5 are similar views to that of FIG. 3, illustrating two alternative embodiments of the invention.

According to the alternative embodiment illustrated by FIG. 4, a tulip-finger main contact 58 is supported by the cylindrical surface 28 of the breaking chamber 26, this tulip-finger contact 58 extending in the direction of a cylindrical-shaped movable main contact 60 securedly fixed to the movable contact 20. By associating the tulip-finger contact 58 with the fixed part of the circuit breaker, the weight of the movable assembly is reduced enabling a notably greater contact separation speed to be achieved.

The insulating end plate 32 of the breaking chamber 16 bears a flange 62 of insulating or conducting material, fitted between the main contacts 58, 60 and the movable contact 20. A flange 62 of this kind can be used on the alternative embodiments described.

Figure 5:
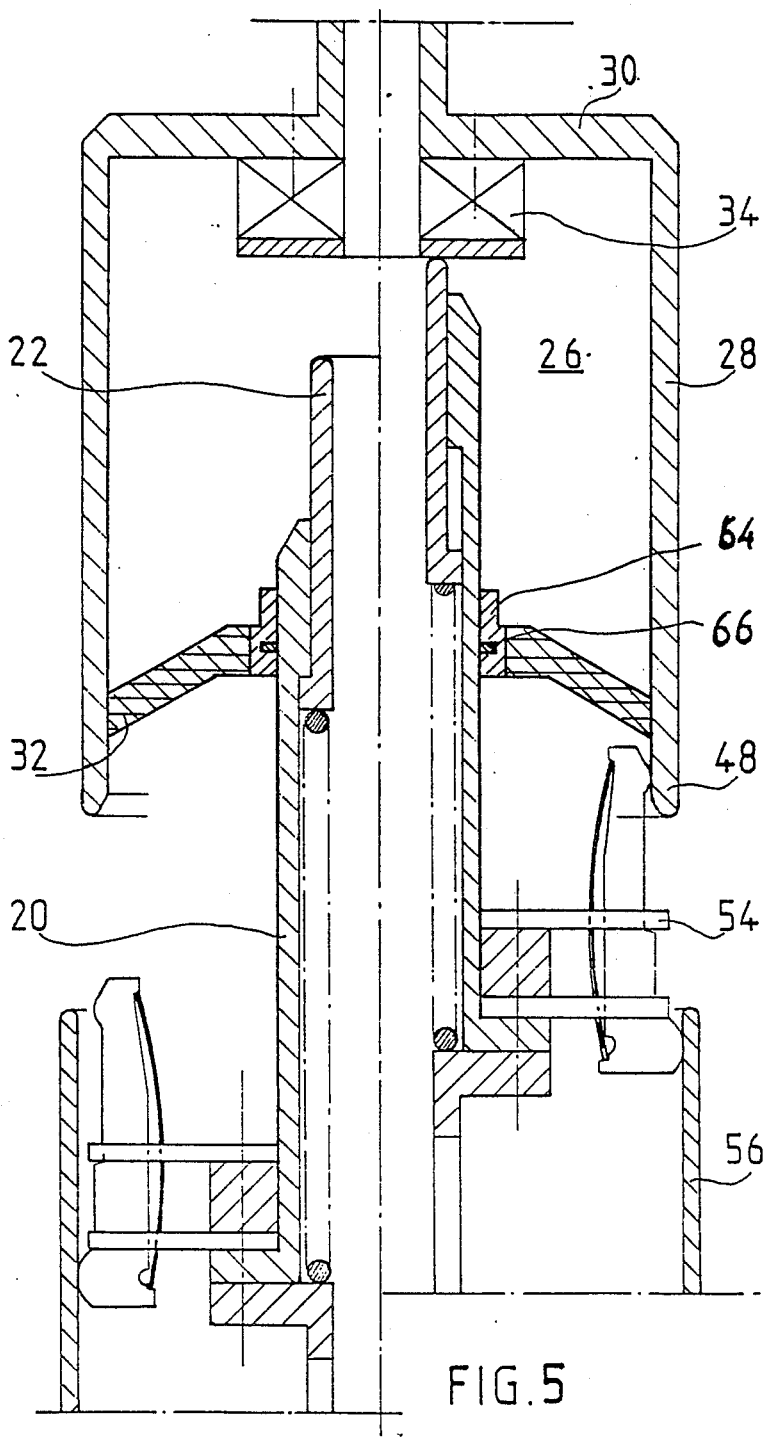

FIG. 5 illustrates a preferred embodiment of the insulating end plate 32, which can naturally be used in the alternative embodiments. The insulating end plate 32 is cone-shaped to increase the creepage distance and provide improved dielectric strength. Between the movable contact 20 and the insulating end plate 32, a metal insert 64 is fitted surrounding the movable contact 20 with small clearance and electrically connected to this movable contact 20 by a sliding contact formed by an elastic metal ring 66 housed in an annular groove of the insert 64 facing the movable contact 20. Any risk of firing in the air gap allowing relative sliding between the movable contact 20 and the insulating end plate 32 is thus avoided.

We claim:

1. A circuit breaker with a sealed enclosure filled with a high dielectric strength gas and containing one or more poles of the circuit breaker, each pole comprising:

a breaking chamber having a revolution surface tightly sealed at both its ends by end plates;

a pair of arcing contacts having a contact area in a closed position and an arcing contact separation area in a separated position, at least one of these arching contacts being tubular, coaxially arranged in said breaking chamber and each passing through one of said end plates to make the breaking chamber communicate, in the separated position of the arcing contacts, with said enclosure forming an expansion chamber via gas outflow channels constituted by the tubular arcing contact;

a magnet means supported by one of said end plates inside the breaking chamber so as to create in the arcing contact separation area a magnetic blowout field by rotation of an arc drawn between the separated arcing contacts; and a pair of main contact disposed outside the breaking chamber and arranged to open before the arcing contacts separate when a circuit breaker opening operation takes place, wherein said revolution surface and the end plate supporting the magnet means are made of metal and electrically connected to the arcing contact passing through this end plate, the other end plate being made of insulation material to provide electrical insulation in the open position of the contacts and wherein said revolution surface has an annular edge which is adjacent to the insulation end plate and is arranged as or supports the stationary main contact, the contact area of the arcing contacts being offset to the side of the metal end plate.

2. The circuit breaker according to claim 1, having a sliding movable arcing contact and a stationary arcing contact wherein the insulating end plate of the breaking chamber has passing through it the sliding movable arcing contact which cooperates with the stationary arcing contact passing through the metal end plate to which it is electrically and mechanically connected.

3. The circuit breaker according to claim 2, having a magnetic arc blowout coil and an annular electrode forming an arc migration track associated with the stationary arcing contact which passes axially through the coil, which coil comprises on face adjoined and electrically connected to the metal end plate, and an other face being capped by said annular electrode.

4. The circuit breaker according to claim 2, having an operating rod passing tightly through the sealed enclosure and a tulip-finger movable main contact securely fixed to the movable arcing contact and operating rod assembly, wherein the tubular movable arcing contact passes through the insulating end plate of the breading chamber and is extended by said operating rod.

5. The circuit breaker according to claim 2, wherein the movable main contact comprises a tulip-finger contact bridge securely fixed to the movable arcing contact and capable of bridging, in the closed position of the circuit breaker, an insulation gap between two stationary main contacts facing one another.

6. The circuit breaker according to claim 1, wherein said annular edge of said revolution surface bears a tulip-finger stationary main contact capable of cooperating with a movable main contact in the shape of a cylindrical ring.

7. The circuit breaker according to claim 1, having a cone-shaped insulation end plate which comprises a metal insert surrounding with small clearance the movable arcing contact to which said insert is electrically connected.

* * * * *